US012319321B2

(12) United States Patent
Jun

(10) Patent No.: US 12,319,321 B2
(45) Date of Patent: Jun. 3, 2025

(54) TRANSPORT SYSTEM IN FABRICATION FACILITY

(71) Applicant: SEMES CO., LTD., Cheonan-si (KR)

(72) Inventor: Sang Pyo Jun, Cheonan-si (KR)

(73) Assignee: SEMES CO., LTD., Cheonan-si (KR)

( * ) Notice: Subject to any disclaimer, the term of this patent is extended or adjusted under 35 U.S.C. 154(b) by 876 days.

(21) Appl. No.: 17/494,769

(22) Filed: Oct. 5, 2021

(65) Prior Publication Data

US 2022/0105966 A1 Apr. 7, 2022

(30) Foreign Application Priority Data

Oct. 6, 2020 (KR) ..... 10-2020-0128815

(51) Int. Cl.
*B61B 13/12* (2006.01)
*B61B 10/00* (2006.01)

(52) U.S. Cl.
CPC ..... *B61B 13/127* (2013.01); *B61B 10/001* (2013.01)

(58) Field of Classification Search
CPC ..... B61B 13/127; B61B 10/001
See application file for complete search history.

(56) References Cited

U.S. PATENT DOCUMENTS 8,245,647 B2 * 8/2012 Oguro ..... H01L 21/67736 104/96
9,150,388 B2 * 10/2015 Yoo ..... B66C 7/02
10,160,624 B2 * 12/2018 Murakami ..... B66C 9/14
11,208,119 B2 * 12/2021 Lim ..... G02F 1/13
11,993,154 B2 * 5/2024 Shimizu ..... B62D 5/04
12,084,093 B2 * 9/2024 Otsuka ..... B61C 13/00
2010/0074717 A1 * 3/2010 Huang ..... H01L 21/67727 414/806
2013/0269564 A1 * 10/2013 Yoo ..... B66C 9/06 104/91
2016/0152450 A1 * 6/2016 Murakami ..... B66C 9/04 212/328
2022/0105966 A1 * 4/2022 Jun ..... B61B 3/02
2023/0023137 A1 * 1/2023 Van Mil ..... A01G 9/143
2024/0174451 A1 * 5/2024 Kim ..... H01L 21/67736

FOREIGN PATENT DOCUMENTS

CN 107934416 A * 4/2018 ..... B60L 5/00
JP 61-293760 12/1986
JP 11-085272 3/1999
JP 2016-110193 6/2016
KR 10-2013-0117143 10/2013
KR 20130117143 A * 10/2013
KR 20240003654 A * 1/2024
KR 20240016202 A * 2/2024
KR 20240088603 A * 6/2024
WO WO-2007108786 A1 * 9/2007 ..... B61B 10/001

OTHER PUBLICATIONS

Office Action from the Japan Patent Office dated Dec. 6, 2022.
Office Action from the Korean Intellectual Property Office dated Feb. 16, 2023.

* cited by examiner

*Primary Examiner* — Jason C Smith

(57) ABSTRACT

A transport system in a fabrication facility includes a driving unit moving along a driving rail, and a steering unit selectively contacting a steering guide rail at a branching part where the driving rail branches off. The steering unit includes horizontal steering wheels contacting a vertical guide part of the steering guide rail, and vertical steering wheels contacting a horizontal guide part of the steering guide rail.

17 Claims, 9 Drawing Sheets

TRANSPORT SYSTEM IN FABRICATION FACILITY

CROSS REFERENCE TO RELATED APPLICATION

The present application claims priority to Korean Patent Application No. 10-2020-0128815, filed on Oct. 6, 2020, the entire contents of which is incorporated herein for all purposes by this reference.

BACKGROUND OF THE INVENTION

Field of the Invention

The present disclosure relates to a transport system in a fabrication facility. More particularly, the present disclosure is to provide a transport vehicle, a rail, and a transport system so that the transport vehicle may smoothly drive on a branching part of a drive path.

Description of the Related Art

A semiconductor (or display) manufacturing process is a process for fabricating a semiconductor element on a substrate (for example, a wafer) and includes, for example, exposure, deposition, etching, ion implantation, cleaning, packaging, and the like. A fabrication facility configured to fabricate the semiconductor element consists of cleanrooms of at least one floor, and fabrication facilities configured to perform a semiconductor fabricating process are arranged on each floor.

In order to maximize an efficiency of the semiconductor fabricating process, not only a method of improving each semiconductor fabricating process, but also a technique for rapidly and efficiently transporting articles (for example, a substrate) between fabrication facilities has been introduced. Typically, an overhead hoist transport (OHT) system that transports articles along a path installed on a ceiling of a semiconductor fabrication facility is being applied. In general, the OHT system includes a rail constituting a drive path, and a transport vehicle that drives along the rail and transports the articles. In addition, when it is necessary to store the articles during transport between semiconductor fabrication facilities, a storage system for storing the articles may be provided.

On the other hand, a branching part of a drive path, configured to guide the vehicle to selectively drive from one of the drive paths to one of at least two paths, is famed. At the branching part, the transport vehicle may drive in a straight movement direction or may drive in a branching direction. As a speed of the transport vehicle is demanded, a technique for smoothly driving the transport vehicle while suppressing vibration or shock generated during straight movement or branching driving is required.

The foregoing is intended merely to aid in the understanding of the background of the present disclosure, and is not intended to mean that the present disclosure falls within the purview of the related art that is already known to those skilled in the art.

SUMMARY OF THE INVENTION

Accordingly, an embodiment of the present disclosure provides a transport vehicle, a rail, and a transport system so that the transport vehicle may smoothly drive on a branching part of a drive path.

In addition, the problems to be solved of the present disclosure are not limited to those mentioned above, and other problems not mentioned will be clearly understood by those skilled in the art from the following description.

In order to achieve the above objective, according to an embodiment of the present disclosure, there may be provided a transport vehicle configured to transport in a transport system in a fabrication facility, the transport vehicle including: a driving unit configured to move along a driving rail; and a steering unit configured to selectively contact a steering guide rail at a branching part where the driving rail branches off, wherein the steering unit may include: horizontal steering wheels configured to be in contact with a vertical guide part of the steering guide rail; and vertical steering wheels configured to be in contact with a horizontal guide part of the steering guide rail.

In the embodiment, the steering unit may further include: a movable body configured to move in a direction perpendicular to a moving direction of the transport vehicle; a horizontal body coupled to the movable body; and a vertical body coupled to a top part of the horizontal body.

In the embodiment, the movable body may move in a direction opposite to the moving direction of the transport vehicle at the branching part.

In the embodiment, the horizontal steering wheels may be provided as a pair of horizontal steering wheels coupled to the horizontal body; and the vertical steering wheels may be provided as a pair of vertical steering wheels coupled to the vertical body.

In the embodiment, an interval between the pair of vertical steering wheels may be set to be greater than a spaced distance that the horizontal guide part is spaced apart at an intersection of a straight movement drive guide rail and a branch drive guide rail.

According to an embodiment of the present disclosure, there may be provided a rail for a movement of a transport vehicle in a transport system in a fabrication facility, the rail including: a driving rail configured to provide a path for the transport vehicle to drive; and a steering guide rail configured to guide a driving direction of the transport vehicle at a branching part where the driving rail branches off. The steering guide rail may include: a vertical guide part configured to guide the transport vehicle in contact with horizontal steering wheels of the transport vehicle; and a horizontal guide part configured to guide the transport vehicle in contact with vertical steering wheels of the transport vehicle.

In the embodiment, the horizontal guide part may include: a vertical structure installed to face the vertical guide part; and a horizontal structure protruding in a horizontal direction from and coupled to the vertical structure.

In the embodiment, the steering guide rail may include: a straight movement drive guide rail configured to guide the transport vehicle in a straight movement direction; and a branch drive guide rail configured to guide the transport vehicle in a branching direction.

In the embodiment, the branch drive guide rail extends in the branching direction across the straight movement drive guide rail from a first side of the straight movement drive guide rail to a second side, opposite to the first side, of the straight movement drive guide rail.

In the embodiment, at the intersection, a spaced distance that the horizontal guide part is spaced apart may be smaller than an interval between a pair of vertical steering wheels of the transport vehicle.

According to an embodiment of the present disclosure, there may be provided a transport system in a fabrication facility, the system including: a transport vehicle configured to transport; and a rail for a movement of the transport vehicle. The rail may include: a driving rail configured to provide a path for the transport vehicle to drive; and a steering guide rail configured to guide a driving direction of the transport vehicle at a branching part where the driving rail branches off. The steering guide rail may include: a vertical guide part configured to guide the transport vehicle in contact with horizontal steering wheels of the transport vehicle; and a horizontal guide part configured to guide the transport vehicle in contact with the vertical steering wheels of the transport vehicle.

As described above, according to the embodiment of the present disclosure, the horizontal steering wheels of the transport vehicle contact the vertical guide part of the steering guide rail during branching driving and the vertical steering wheels of the transport vehicle contact the horizontal guide part of the steering guide rail so that the transport vehicle can drive on the branching part of a drive path more smoothly.

In addition, effects of the present disclosure are not limited to those mentioned above, and other effects not mentioned will be clearly understood by those skilled in the art from the following description.

BRIEF DESCRIPTION OF THE DRAWINGS

The above and other objectives, features, and other advantages of the present disclosure will be more clearly understood from the following detailed description when taken in conjunction with the accompanying drawings, in which.

DETAILED DESCRIPTION OF THE INVENTION

Figure 1:
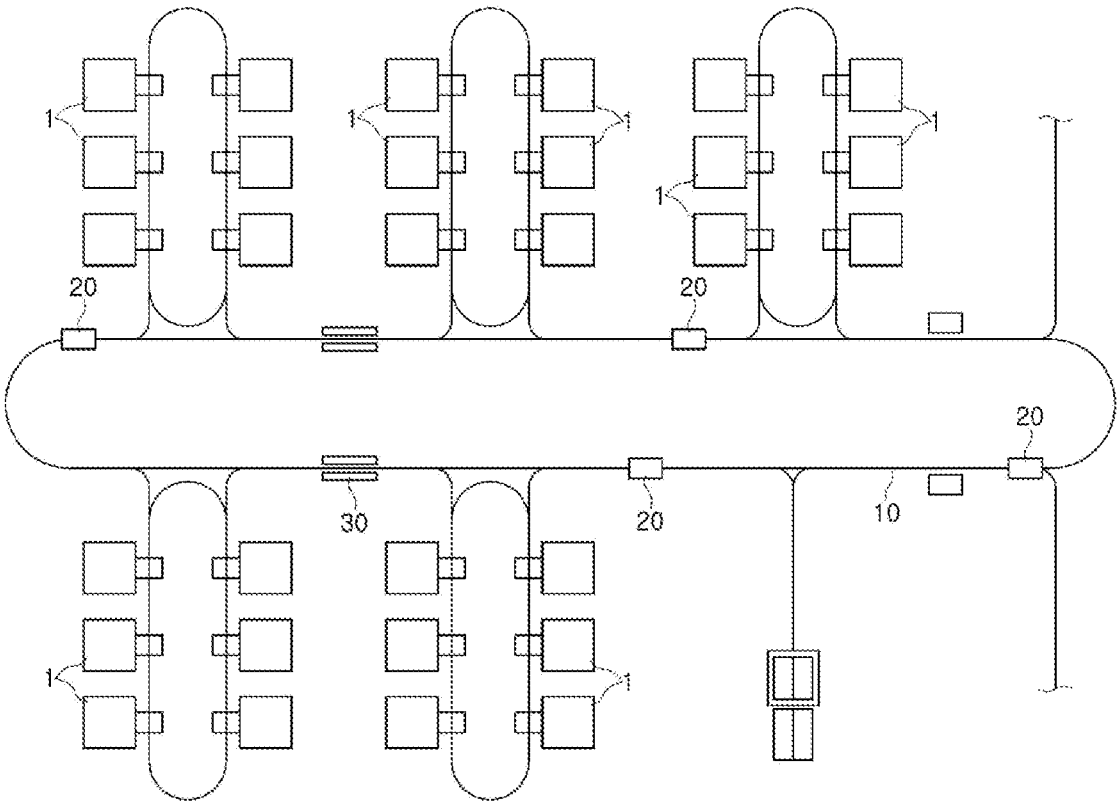
FIG. 1 shows an example of a transport system in a fabrication facility.

Hereinafter, with reference to the accompanying drawings, embodiments of the present disclosure will be described in detail so that those of ordinary skill in the art to which the present disclosure pertains may easily implement the embodiments. The present disclosure may be embodied in many different forms and is not limited to the embodiments described herein.

In order to clearly explain the present disclosure, parts irrelevant to the description are omitted, and the same reference numerals are assigned to the same or similar elements throughout the specification.

In addition, in various embodiments, components having the same configuration will be described only in the representative embodiment using the same reference numerals, and only configurations different from the representative embodiment will be described in other embodiments different from the representative embodiment.

Throughout the specification, when a part is referred to as being "connected" or "coupled" to another part, this includes not only a case in which the part is "directly connected (or coupled)" to another part but also a case in which the part is "indirectly connected (or coupled)" to another part with other members therebetween. In addition, when a part "includes" a certain component, this means that other components may be further included, rather than excluding other components unless otherwise stated.

Unless otherwise defined, all terms used herein, including technical or scientific terms, have the same meaning as commonly understood by one of ordinary skill in the art to which the present disclosure belongs. Terms such as those defined in a commonly used dictionary should be interpreted as having a meaning consistent with the meaning in the context of the related art, and should not be interpreted in an ideal or excessively formal meaning unless explicitly defined in the present application.

FIG. 1 shows an example of a transport system in a fabrication facility. A semiconductor or display fabricating line consists of at least one cleanroom, and fabrication facilities 1 configured to perform a fabricating process may be installed in each cleanroom. In general, a finally processed substrate may be completed by repeatedly performing a plurality of fabricating processes on a substrate (for example, a wafer). When the substrate process is completed in a specific semiconductor substrate facility 1, the substrate is transported to a facility for the next fabricating process. Here, the substrate may be transported in a state stored in a container (for example, front opening unified pod, FOUP) capable of accommodating a plurality of substrates. The container accommodating the substrates may be transported by a transport vehicle (for example, overhead hoist transport (OHT)) 20.

The transport vehicle 20 drives on a rail 10 installed on a ceiling and interfaces with a higher server (vehicle controller) that instructs a transport operation command in a wireless communication manner. The vehicle controller receives a transfer command according to a work process from an integrated control system, and according to the command of the integrated control system, searches a shortest path from an origin to a destination in order to complete the transfer operation in a shortest time for the transport vehicle 20 according to the command of the integrated control system, and selects the transport vehicle 20 in an optimal position suitable for carrying out the transfer operation and orders a transfer command to the transport vehicle 20. According to the transfer command of the vehicle controller, the transport vehicle 20 transfers articles from an arbitrary port commanded by the vehicle controller to the destination port.

With reference to FIG. 1, fabrication facilities 1 configured to perform a process are installed in a semiconductor or display fabricating line, and a plurality of transport vehicles 20 may be provided for transporting the articles to the fabrication facilities 1 while driving on the rail 10 and the rail 10 that form the transport path for transporting the articles between the fabrication facilities 1. In this case, the transport vehicle 20 may receive driving power through a power supply unit (for example, a power supply cable) formed along the rail 10.

When the transport vehicle 20 transports the articles between the fabrication facilities 1, the articles may be directly transported from a specific fabrication facility to another fabrication facility or may be transported to another fabrication facility after the articles are stored in a storage device. A storage device (for example, article storage unit 30) may be installed on one side of the rail 10. The storage device may include: a rack-type warehouse (stocker) capable of injecting inert gas to maintain a clean environment in the container; and a rail side surface buffer installed adjacent to the side surface of the rail 10 and configured to store goods, a rail bottom buffer installed at a region under the rail 10 and configured to store the articles, or a maintenance and repair lifter configured to maintain and repair the transport vehicle.

Figure 2:
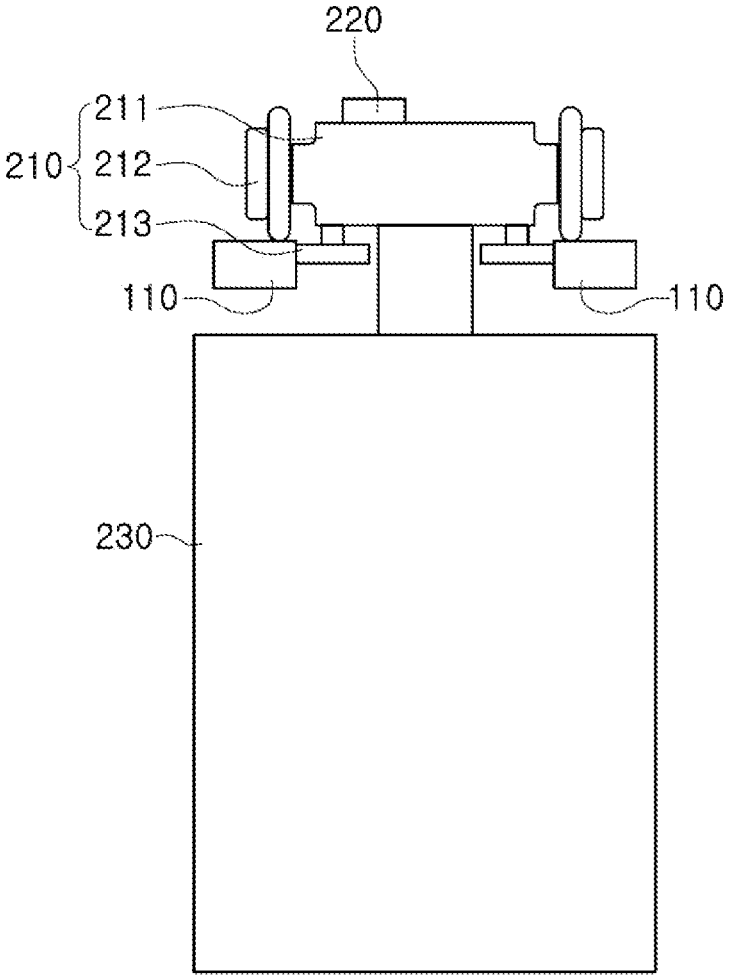
FIGS. 2 and 3 show a schematic structure of a transport vehicle according to an embodiment of the present disclosure.
Figure 3:
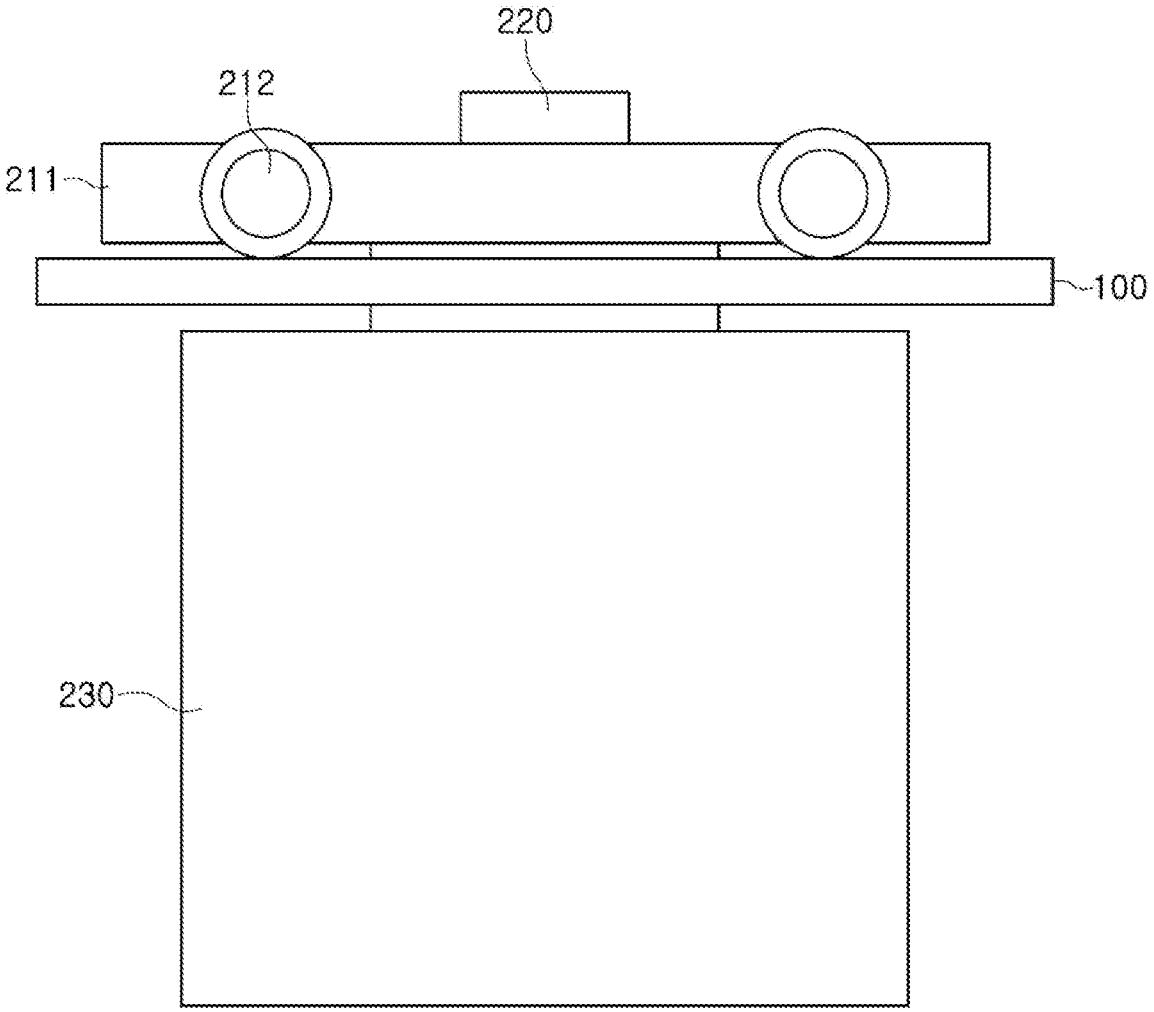

FIGS. 2 and 3 show a schematic structure of the transport vehicle 20 according to an embodiment of the present disclosure. Here, FIG. 2 shows the transport vehicle 20 as viewed from a direction of a drive path, and FIG. 3 shows the transport vehicle 20 as viewed from a side surface of the drive path.

With reference to FIGS. 2 and 3, the transport vehicle 20 includes: a driving unit 210 configured to drive along a driving rail 110; a steering unit 220 configured to selectively contact a steering guide rail at a branching part where the driving rail 110 branches off; and a grasping unit 230 configured to grasp the transported articles.

The driving unit 210 includes: a driving body 211 in which devices configured to drive the transport vehicle 20 are installed; a driving wheel 212 configured to rotate in contact with the driving rail 110; and a drive guide wheel 213 configured to rotate in contact along a side surface of the driving rail 110. The transport vehicle 20 drives along the driving rail 110 by rotation of the driving wheel 212, and the driving guide wheel 213 may prevent the transport vehicle 20 from being separated from the driving rail 110.

The steering unit 220 is a device configured to guide the transport vehicle 20 to selectively drive at the branching part, and a detailed configuration of the steering unit 220 according to the embodiment of the present disclosure will be described in detail hereinbelow. The grasping unit 230 grasps the articles to be transported and may load or unload the articles to each of the facilities 1 through elevating/lowering driving.

Figure 4:
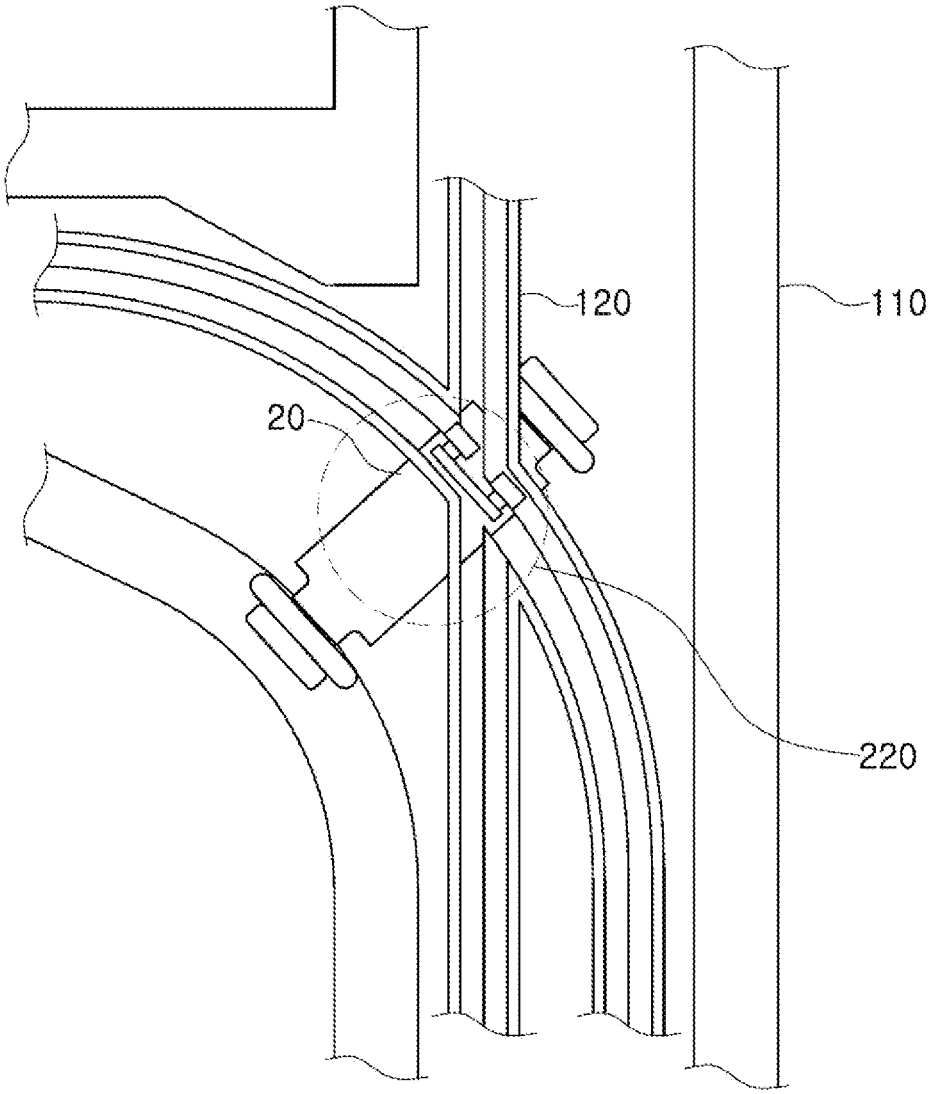
FIGS. 4 and 5 show an example of the transport vehicle driving at a branching part of a drive path in the transport system according to the embodiment of the present disclosure.
Figure 5:
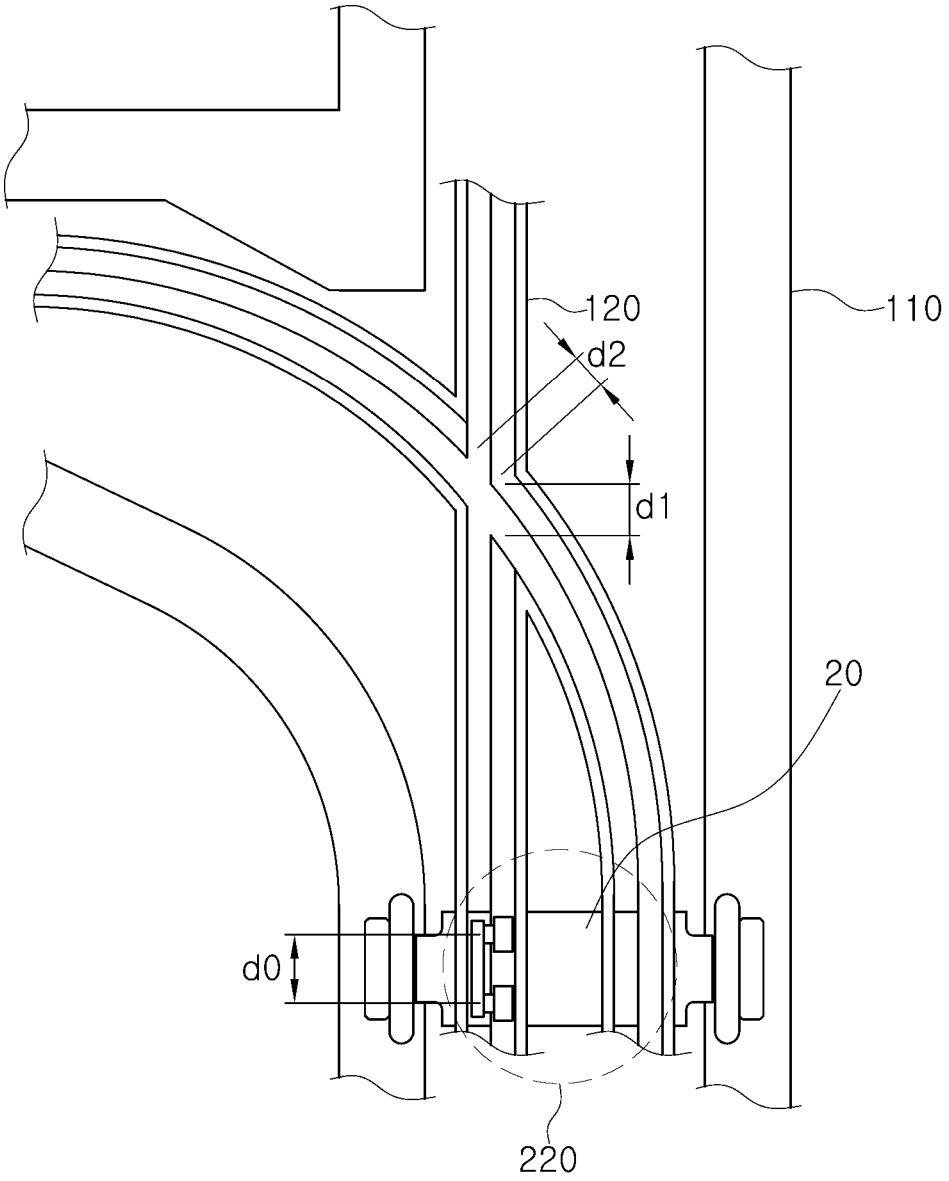

FIGS. 4 and 5 show an example of the transport vehicle driving at a branching part of a drive path in the transport system according to the embodiment of the present disclosure. Here, FIG. 4 shows a case in which the transport vehicle 20 drives in the branching direction from the branching part, and FIG. 5 shows a case in which the transport vehicle 20 drives in the straight movement direction at the branching part.

As shown in FIGS. 4 and 5, a branch steering guide rail of a steering guide rail 120 is formed in a branching direction through an intersection with a straight movement drive guide rail from an opposite direction to the branching direction. As shown in FIG. 4, when the transport vehicle 20 drives in the branching direction (for example, left direction), the steering unit 220 of the transport vehicle 20 moves in a direction opposite to the branching direction (for example, right direction). Meanwhile, as shown in FIG. 5, when the transport vehicle 20 drives in a straight movement direction, the steering unit 220 of the transport vehicle 20 moves in the branching direction (for example, left direction). The steering guide rail 120 is configured as shown in FIGS. 4 and 5, and the steering unit 220 of the transport vehicle 20 drives along the steering guide rail 120. As a result, the shock and vibration, which may occur when the transport vehicle 20 drives in the branching direction, may be reduced.

In addition, as shown in FIGS. 4 and 5, when the transport vehicle 20 drives in the branching direction, a driving wheel 212 on one side of the transport vehicle 20 is in contact with the driving rail 110, but a driving wheel 212 on an opposite side of the transport vehicle 20 is in a state of being lifted from the driving rail in the air without contacting the driving rail 110. According to the embodiment of the present disclosure, vertical steering wheels 222 of the steering unit 220 come into contact with a horizontal guide part 122 of the steering guide rail 120 to drive, instead of the driving wheel 212 on the opposite side of the transport vehicle 20. That is, during branching driving, the driving wheel 212 on one side of the transport vehicle 20 drives in contact with the driving rail 110, and at the opposite side of the transport vehicle 20, the vertical steering wheels 222 drive in contact with the horizontal guide part 122 of the steering guide rail 120. Accordingly, the transport vehicle 20 may be prevented from being inclined, and the shocks and vibrations, which may occur when the driving wheel on the opposite side of the transport vehicle 20 is in a state of being lifted from the driving rail in the air, may be alleviated.

Figure 6:
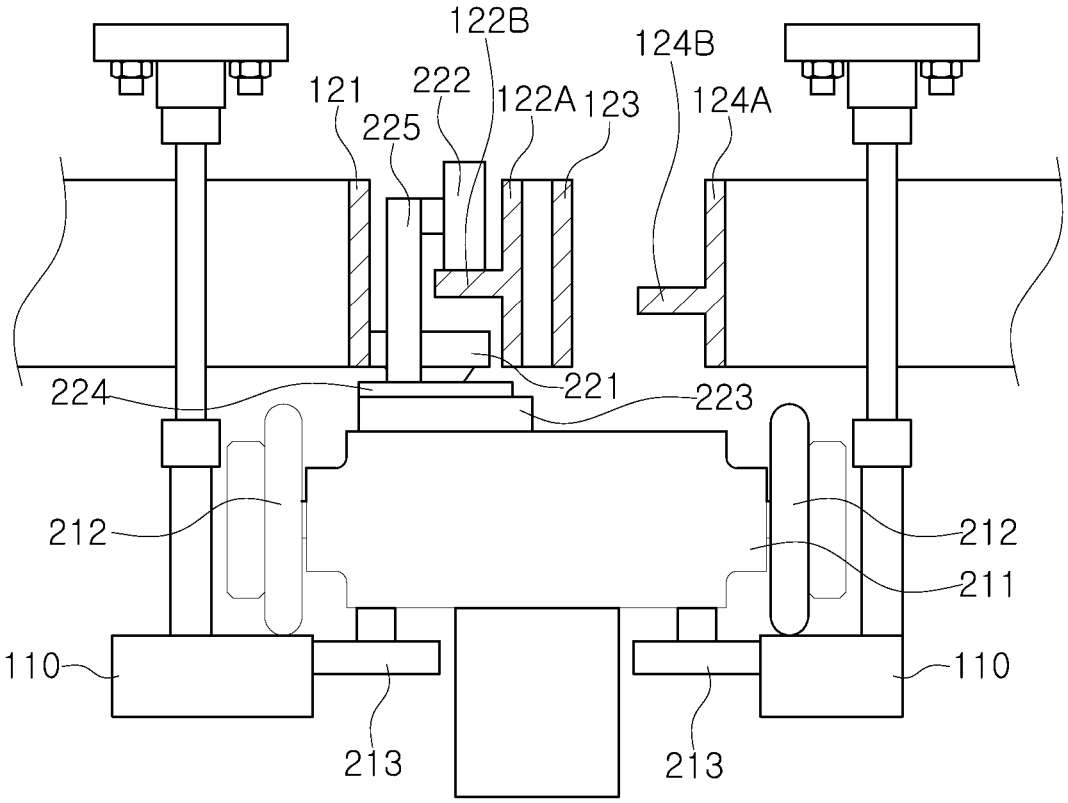
FIG. 6 shows an example of a rail and the transport vehicle in the transport system according to the embodiment of the present disclosure.

FIG. 6 shows an example of a rail 10 and the transport vehicle 20 in the transport system according to the embodiment of the present disclosure. FIG. 6 illustrates a case in which the transport vehicle 20 drives in the straight movement direction as in FIG. 5.

The transport system in a fabrication facility according to the embodiment of the present disclosure includes: the transport vehicle 20 configured to transport; and a rail 10 for a movement of the transport vehicle 20. In the embodiment of the present disclosure, the transport vehicle 20 includes: the driving unit 210 configured to drive along the driving rail 110; and the steering unit 220 configured to selectively contact the steering guide rail 120 at the branching part where the driving rail branches off. The steering unit 220 includes: horizontal steering wheels 221 configured to be in contact with a vertical guide part 121 of the steering guide rail 120; and the vertical steering wheels 222 configured to be in contact with a horizontal guide part 122 of the steering guide rail 120.

According to the embodiment of the present disclosure, the rail 10 includes: a driving rail 110 configured to provide a path for the transport vehicle 20 to drive; and a steering guide rail 120 configured to guide a driving direction of the transport vehicle 20 at a branching part where the driving rail 110 branches off. The steering guide rail 120 includes: the vertical guide part 121 configured to guide the transport vehicle 20 in contact with the horizontal steering wheels 221 of the transport vehicle 20; and the horizontal guide part 122 configured to guide the transport vehicle in contact with the vertical steering wheels 222 of the transport vehicle 20.

In the embodiment of the present disclosure, the steering unit 220 further includes: a movable body 223 configured to move in a direction perpendicular to a moving direction of the transport vehicle 20; a horizontal body 224 coupled to the movable body 223; and a vertical body 225 coupled to a top part of the horizontal body 224. As shown in FIG. 6, the movable body 223 may move in a direction (left and right direction) perpendicular to the driving direction of the transport vehicle 20 along the guide rail in the steering unit 220. The horizontal body 224 may be installed on the top part of the movable body 223, and the vertical body 225 may be installed on the top part of the horizontal body 224.

In the embodiment of the present disclosure, the movable body 223 may move in a direction opposite to the moving direction of the transport vehicle 20 at the branching part. That is, as shown in FIGS. 4 and 5, when the transport vehicle 20 drives in the branching direction (for example, left direction), the movable body 223 moves in the opposite direction to the branching direction (for example, right direction), and when the transport vehicle 20 drives in the straight movement direction, the movable body 223 moves in the branching direction (for example, left direction). The steering guide rail 120 is configured as shown in FIGS. 4 and 5, and the steering unit 220 of the transport vehicle 20 drives along the steering guide rail 120. As a result, the shock and vibration, which may occur when the transport vehicle 20 drives in the branching direction, may be reduced.

Figure 8:
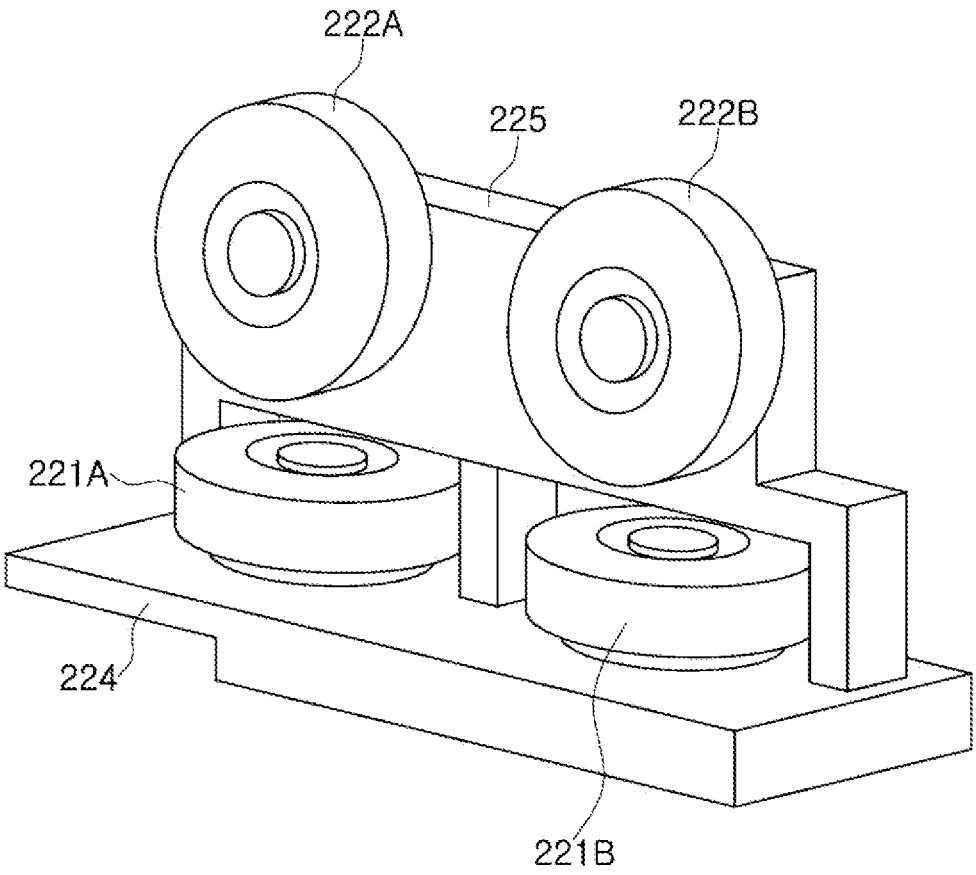
FIG. 8 shows an example of a steering unit of the transport vehicle according to the embodiment of the present disclosure.

In the embodiment of the present disclosure, the horizontal steering wheels 221 may be provided as a pair of horizontal steering wheels coupled to the horizontal body 224, and the vertical steering wheels 222 may be provided as a pair of vertical steering wheels coupled to the vertical body 225. That is, the horizontal steering wheels 221 and the vertical steering wheels 222 may be composed of a pair of wheels spaced apart from each other at a predetermined distance in a front-rear direction, respectively. With reference to FIG. 8, the horizontal steering wheels 221 may include a front horizontal steering wheel 221A and a rear horizontal steering wheel 221B both of which are coupled to the horizontal body 224. In addition, the vertical steering wheels 222 may include a front vertical steering wheel 222A and a rear vertical steering wheel 222B.

Here, an interval (d0) between the pair of vertical steering wheels 222 may be set to be greater than a spaced distance (d1, d2) that the horizontal guide part 122 is spaced apart at the intersection of a straight movement drive guide rail and a branch drive guide rail. That is, by making up the interval between the front vertical steering wheel 222A and the rear vertical steering wheel 222B to be greater than a length of an area where the horizontal guide part 122 at the intersection does not exist and is spaced apart, at least one of the front vertical steering wheel 222A and the rear vertical steering wheel 222B is always in contact with the horizontal guide part 122 of the steering guide rail 120. Through this manner, it is possible to prevent a case in which the vertical steering wheels 222 are in a state of being separated from the horizontal guide part of the steering guide rail in the air, and shock and vibration, which may occur when the vertical steering wheels 222 are in the state of being separated from the horizontal guide part of the steering guide rail in the air, may be reduced.

Meanwhile, according to the embodiment of the present disclosure, the horizontal guide part 122 of the steering guide rail 120 may include: a vertical structure 122A installed to face the vertical guide part 121; and a horizontal structure 122B protruding in a horizontal direction from and coupled to the vertical structure 122A.

Figure 7:
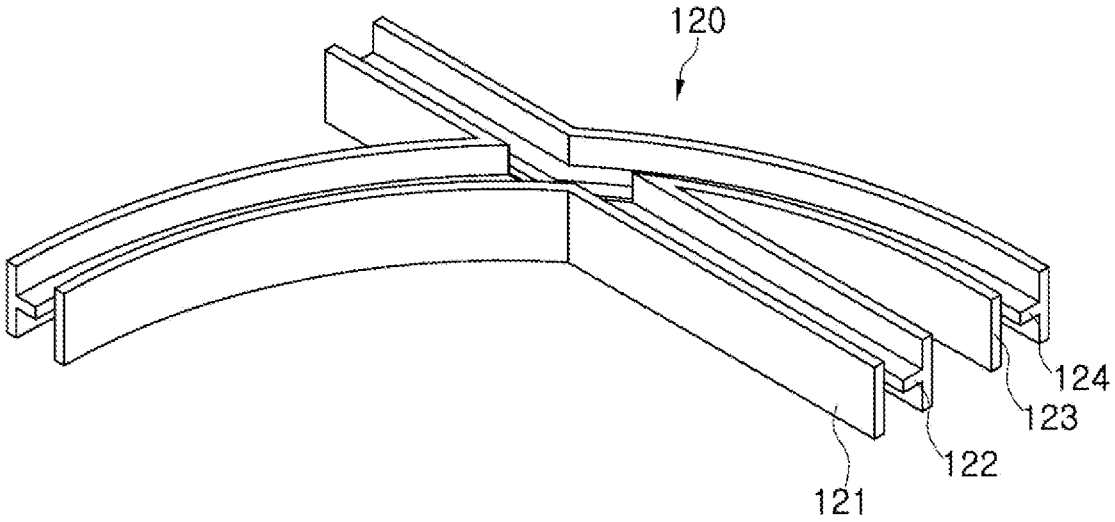
FIG. 7 shows an example of a steering guide rail according to the embodiment of the present disclosure.

In the embodiment of the present disclosure, the steering guide rail 120 may include: a straight movement drive guide rail configured to guide the transport vehicle 20 in a straight movement direction; and a branch drive guide rail configured to guide the transport vehicle 20 in a branching direction. With reference to FIG. 7, the straight movement drive guide rail may include: the straight movement drive vertical guide part 121; and the straight movement drive horizontal guide part 122, and the branch drive guide rail may include: a branch drive vertical guide part 123; and a straight movement drive horizontal guide part 124.

In the embodiment of the present disclosure, the branch drive guide rail may be formed in a branching direction through the intersection with the straight movement drive guide rail from an opposite side to the branching direction. As shown in FIG. 7, the branch drive guide rails 123 and 124 are formed in a branching direction through the intersection with the straight movement drive guide rails 121 and 122 from the opposite direction to the branching direction. In some embodiments, the branch drive guide rails 123 and 124 extend in the branching direction across the straight movement drive guide rails 121 and 122 from a first side of the straight movement drive guide rails 121 and 122 to a second side, opposite to the first side, of the straight movement drive guide rails 121 and 122.

Figure 9:
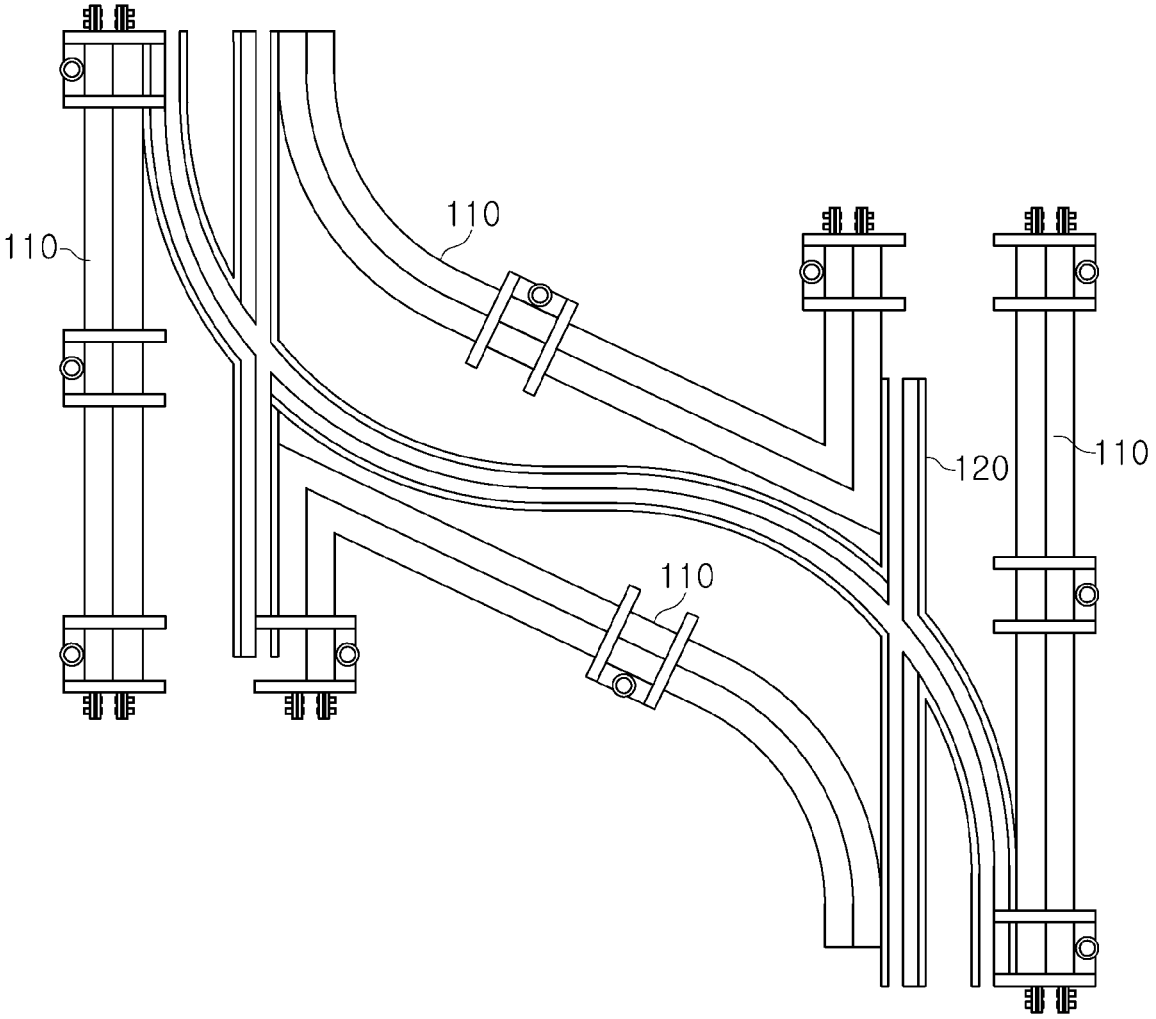
FIG. 9 shows the branching part of a drive path of the rail according to the embodiment of the present disclosure.

In addition, as shown in FIG. 9, in order to implement an N-shaped branching part, the branch drive guide rails 123 and 124 may be formed in the branching direction through the intersection with the straight movement drive guide rails 121 and 122 from the opposite direction to the branching direction and may be formed to extend in an outer side direction of a curved path along which the transport vehicle 20 drives again at a merging part. In this case, at least one of the front vertical steering wheel 222A and the rear vertical steering wheel 222B is always in contact with the horizontal guide part 122 of the steering guide rail 120 at both the branching part and the merging part. Through this manner, it is possible to prevent a case in which the vertical steering wheels 222 are in a state of being separated from the horizontal guide part of the steering guide rail in the air at the branching part and the merging part, and shock and vibration, which may occur when the vertical steering wheels 222 are in the in the state of being separated from the horizontal guide part of the steering guide rail, may be reduced.

As described above, at the intersection, the spaced distance (d1, d2) that the horizontal guide part 122 is spaced apart is set to be smaller than the interval (d0) between the pair of vertical steering wheels of the transport vehicle 20. That is, at the intersection, by making up the spaced distance (d1, d2) that the horizontal guide part 122 is spaced apart is set to be smaller than the interval (d0) between the front vertical steering wheel 222A and the rear vertical steering wheel 222B, at least one of the front vertical steering wheel 222A and the rear vertical steering wheel 222B is always in contact with the horizontal guide part 122 of the steering guide rail 120. Through this manner, it is possible to prevent a case in which the vertical steering wheels 222 are in a state of being separated from the horizontal guide part of the steering guide rail in the air, and shock and vibration, which may occur when the vertical steering wheels 222 are in the state of being separated from the horizontal guide part of the steering guide rail in the air, may be reduced.

In addition, according to the embodiment of the present disclosure, the vertical steering wheels 222 may be configured not only on each of the front and rear parts of the vertical body 225 but also on each of opposite sides of the vertical body 225 with the vertical body as a center. In this case, a horizontal structure 122B to which one of the vertical steering wheels 222 may contact is also formed on the vertical guide part 121 of the steering guide rail 120. That is, the vertical steering wheels 222 are configured on the opposite sides of the vertical body 225 with the vertical body as the center, respectively, and horizontal structures are configured on the vertical guide part 121 and the horizontal guide part 122, respectively, so that the vertical steering wheels 222 may contact both of the horizontal structures, respectively. As a result, it is possible to make the transport vehicle 20 drive on the branching part more stably.

The embodiment and the drawings attached to the present specification merely clearly show some of the technical ideas included in the present disclosure, and it will be apparent that all possible modifications and specific embodiments, which those skilled in the art may easily infer within the scope of the technical ideas included in the specification and drawings of the present disclosure, are included in the scope of the present disclosure.

Therefore, the spirit of the present disclosure should not be limited to the described embodiments, and not only the claims to be described later, but also all those with equivalent or equivalent modifications to the claims will be said to belong to the scope of the spirit of the present disclosure.

What is claimed is:

1. A transport vehicle configured to transport in a transport system in a fabrication facility, the transport vehicle comprising:

a driving unit configured to move along a driving rail; and a steering unit configured to selectively contact a steering guide rail at a branching part where the driving rail branches off, wherein the steering unit comprises:

a plurality of horizontal steering wheels configured to:

rotate around a first axis extending in a vertical direction; and selectively contact a vertical guide part of the steering guide rail; and a plurality of vertical steering wheels configured to:

rotate around a second axis extending in a horizontal direction; and selectively contact a horizontal guide part of the steering guide rail, wherein the horizontal guide part and the vertical guide part are physically separated from each other, wherein the steering unit further comprises:

a movable body configured to move in a direction perpendicular to a moving direction of the transport vehicle;

a horizontal body coupled to the movable body; and a vertical body coupled to a top part of the horizontal body, wherein the vertical body includes an opening in which the plurality of horizontal steering wheels are disposed, wherein the opening horizontally penetrates the vertical body the vertical body, and wherein the vertical body vertically overlaps the plurality of horizontal steering wheels.

2. The transport vehicle of claim 1, wherein the movable body moves in a direction opposite to the moving direction of the transport vehicle at the branching part.

3. The transport vehicle of claim 1, wherein the plurality of horizontal steering wheels are provided as a pair of horizontal steering wheels coupled to the horizontal body, wherein the plurality of vertical steering wheels are provided as a pair of vertical steering wheels coupled to the vertical body, wherein the pair of horizontal steering wheels and the pair of vertical steering wheels are arranged in the same direction, and wherein the pair of horizontal steering wheels vertically overlap the pair of vertical steering wheels, respectively.

4. The transport vehicle of claim 3, wherein an interval between the pair of vertical steering wheels is set to be greater than a spaced distance that the horizontal guide part is spaced apart at an intersection of a straight movement drive guide rail and a branch drive guide rail.

5. A rail for a movement of a transport vehicle in a transport system in a fabrication facility, the rail comprising:

a driving rail configured to provide a path for the transport vehicle to drive; and a steering guide rail configured to guide a driving direction of the transport vehicle at a branching part where the driving rail branches off, wherein the steering guide rail comprises:

a vertical guide part configured to guide the transport vehicle, wherein a plurality of horizontal steering wheels of the transport vehicle contact the vertical guide part; and a horizontal guide part configured to guide the transport vehicle, wherein a plurality of vertical steering wheels of the transport vehicle contact the horizontal guide part, wherein the horizontal guide part comprises:

a vertical structure physically separated from the vertical guide part and installed to face the vertical guide part; and a horizontal structure connected to the vertical structure and protruding toward the vertical guide part in a horizontal direction, wherein the vertical structure of the horizontal guide part extends in parallel to the horizontal guide part, and wherein the horizontal structure of the horizontal guide part is physically separated from the vertical guide part.

6. The rail of claim 5, wherein the steering guide rail comprises:

a straight movement drive guide rail configured to guide the transport vehicle in a straight movement direction; and a branch drive guide rail configured to guide the transport vehicle in a branching direction.

7. The rail of claim 6, wherein the branch drive guide rail extends in the branching direction across the straight movement drive guide rail from a first side of the straight movement drive guide rail to a second side, opposite to the first side, of the straight movement drive guide rail.

8. The rail of claim 7, wherein, at an intersection between the straight movement drive guide rail and the branch drive guide rail, a spaced distance that the horizontal guide part is spaced apart is smaller than an interval between a pair of vertical steering wheels of the transport vehicle.

9. A transport system in a fabrication facility, the transport system comprising:

a transport vehicle; and a rail for a movement of the transport vehicle, wherein the rail comprises:

a driving rail configured to provide a path for the transport vehicle to drive; and a steering guide rail configured to guide a driving direction of the transport vehicle at a branching part where the driving rail branches off, wherein the steering guide rail comprises:

a vertical guide part configured to guide the transport vehicle, with a plurality of horizontal steering wheels of the transport vehicle contacting the vertical guide part; and a horizontal guide part configured to guide the transport vehicle, a plurality of vertical steering wheels of the transport vehicle contacting the horizontal guide part, wherein the horizontal guide part comprises:

a vertical structure physically separated from the vertical guide part and installed to face the vertical guide part; and a horizontal structure connected to the vertical structure and protruding toward the vertical guide part in a horizontal direction, wherein the vertical structure of the horizontal guide part extends in parallel to the horizontal guide part, and wherein the horizontal structure of the horizontal guide part is physically separated from the vertical guide part.

10. The transport system of claim 9, wherein the transport vehicle comprises:

a driving unit configured to move along the driving rail; and a steering unit configured to selectively contact the steering guide rail at the branching part where the driving rail branches off, and wherein the steering unit comprises:

the plurality of horizontal steering wheels configured to:

rotate around a first axis extending in a vertical direction; and selectively contact the vertical guide part of the steering guide rail, and the plurality of vertical steering wheels configured to:

rotate around a second axis extending in the horizontal direction; and selectively contact the horizontal guide part of the steering guide rail.

11. The transport system of claim 10, wherein the steering unit further comprises:

a movable body configured to move in a direction perpendicular to a moving direction of the transport vehicle;

a horizontal body coupled to the movable body; and a vertical body coupled to a top part of the horizontal body, wherein the vertical body includes an opening in which the plurality of horizontal steering wheels are disposed, wherein the opening horizontally penetrates the vertical body the vertical body, and wherein the vertical body vertically overlaps the plurality of horizontal steering wheels.

12. The transport system of claim 11, wherein the movable body moves in a direction opposite to the moving direction of the transport vehicle at the branching part.

13. The transport system of claim 11, wherein the plurality of horizontal steering wheels are provided as a pair of horizontal steering wheels coupled to the horizontal body, wherein the plurality of vertical steering wheels are provided as a pair of vertical steering wheels coupled to the vertical body, wherein the pair of horizontal steering wheels and the pair of vertical steering wheels are arranged in the same direction, and wherein the pair of horizontal steering wheels vertically overlap the pair of vertical steering wheels, respectively.

14. The transport system of claim 13, wherein an interval between the pair of vertical steering wheels is set to be greater than a spaced distance that the horizontal guide part is spaced apart at an intersection of a straight movement drive guide rail and a branch drive guide rail.

15. The transport system of claim 9, wherein the steering guide rail comprises:

a straight movement drive guide rail configured to guide the transport vehicle in a straight movement direction; and a branch drive guide rail configured to guide the transport vehicle in a branching direction.

16. The transport system of claim 15, wherein the branch drive guide rail extends in the branching direction across the straight movement drive guide rail from a first side of the straight movement drive guide rail to a second side, opposite to the first side, of the straight movement drive guide rail.

17. The transport system of claim 16, wherein, at an intersection between the straight movement drive guide rail and the branch drive guide rail, a spaced distance that the horizontal guide part is spaced apart is smaller than an interval between a pair of vertical steering wheels of the transport vehicle.

* * * * *